United States Patent [19]

Colburn

[11] 4,391,411

[45] Jul. 5, 1983

[54] METHOD AND APPARATUS FOR PULVERIZING MATERIALS BY VACUUM COMMINUTION

[75] Inventor: William A. Colburn, Denver, Colo.

[73] Assignee: Process Development Corporation, Denver, Colo.

[21] Appl. No.: 217,679

[22] Filed: Dec. 18, 1980

[51] Int. Cl.[3] ..... B02C 19/18

[52] U.S. Cl. ..... 241/1; 241/29; 241/39; 241/152 R

[58] Field of Search ..... 241/1, 5, 29, 30, 39, 241/152 R, 301

[56] References Cited

U.S. PATENT DOCUMENTS

| | | | |
|---|---|---|---|
| 2,660,564 | 11/1953 | Davis | 241/5 X |
| 3,255,793 | 6/1966 | Clute | 241/301 |
| 3,614,000 | 10/1971 | Blythe | 241/5 |
| 3,881,660 | 5/1975 | Ribas | 241/39 X |
| 4,176,798 | 12/1979 | Talbott et al. | 241/5 X |

FOREIGN PATENT DOCUMENTS

| | | | |
|---|---|---|---|
| 198902 | 6/1967 | U.S.S.R. | 241/1 |
| 560636 | 6/1977 | U.S.S.R. | 241/39 |

*Primary Examiner*—Howard N. Goldberg
*Attorney, Agent, or Firm*—Wm. Griffith Edwards

[57] ABSTRACT

A method and apparatus for comminuting minerals and similar materials by vacuum comminution includes an arrangement for introducing the material to the low pressure chamber at a high velocity whereby the rate of change of pressure on the particles of material is greatly increased. The degree of comminution is thereby increased and the effectiveness of the system greatly enhanced.

10 Claims, 3 Drawing Figures

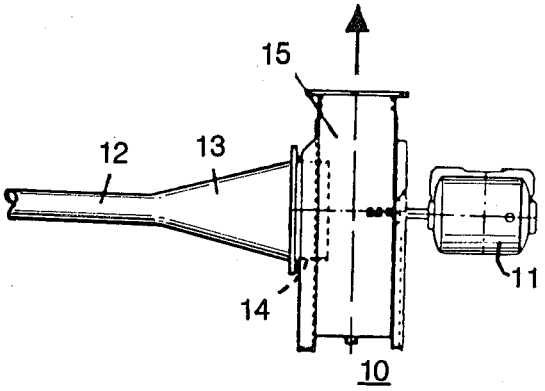
FIG. 1 (PRIOR ART)
FIG. 2 (PRIOR ART)
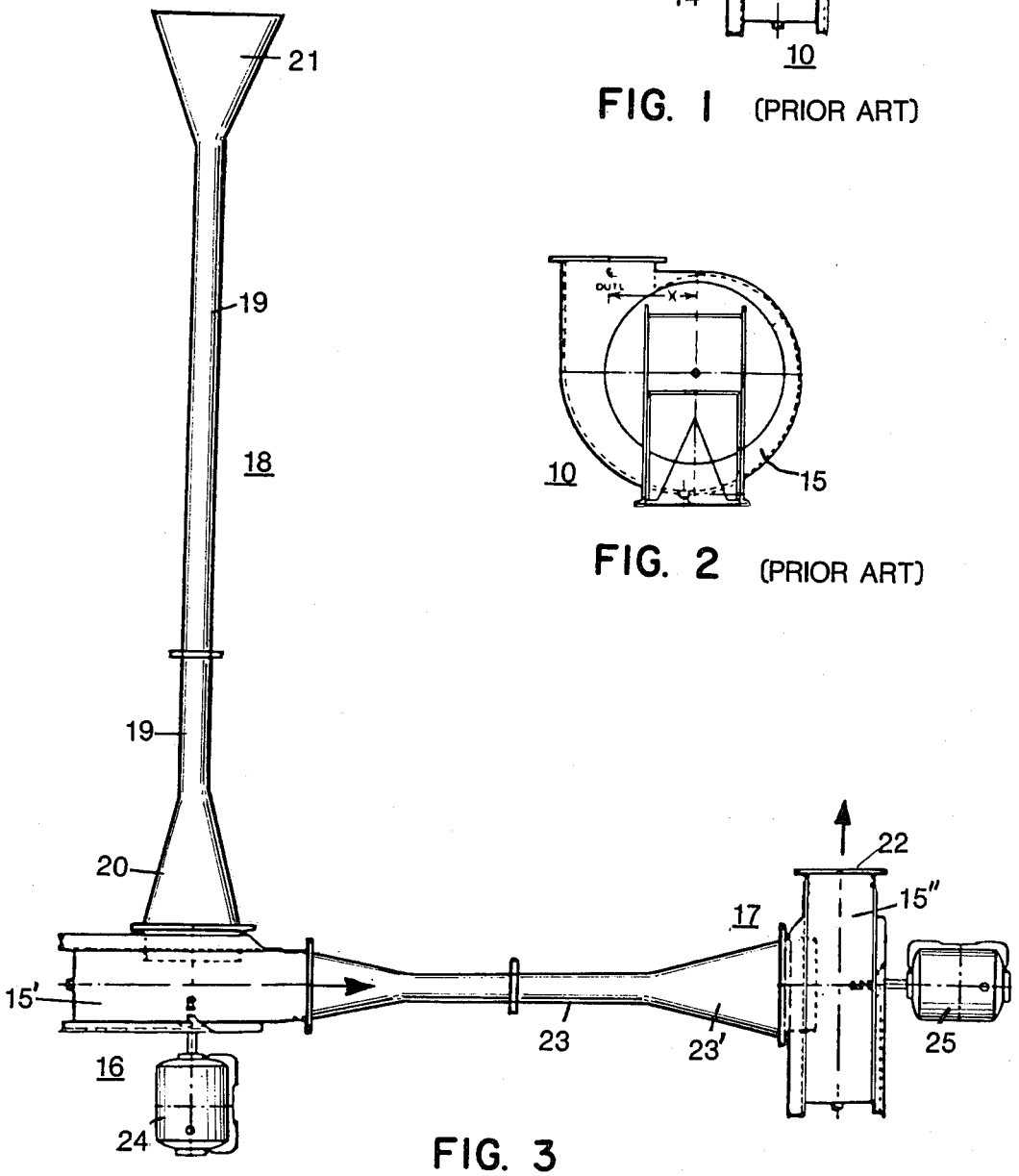
FIG. 3

METHOD AND APPARATUS FOR PULVERIZING MATERIALS BY VACUUM COMMINUTION

This invention relates to the comminution of minerals and mineral-like substances and particularly to an improved vacuum comminuting method and apparatus for pulverizing minerals and the like.

BACKGROUND AND PRIOR ART

Minerals and mineral-like substances including synthetic substances such as concrete have very low tensile strength. When such substances are suddenly subjected to a reduction in ambient pressure, the substance is placed under tension and tends to fracture along areas of zones of weakness. Such areas or zones include grain boundaries, mineral boundaries, material boundaries, cracks, fractures and zones of high stress. This characteristic of the material has been utilized in vacuum comminuting apparatus such as that described in U.S. Pat. No. 3,255,793 to Clute wherein a fan type blower is supplied with air through a chamber which is of frusto-conical configuration so that it increases in cross section from its entrance to the inlet of the blower. During operation of the blower a low pressure zone is created in the conical chamber and the explosive comminution occurs within the conical portion. The patent further states that further comminution may be effected by redirecting the material a number of times through the machine.

U.S. Pat. No. 2,386,401 Joyce, Jr. discloses a method for fiberizing asbestos. The asbestos is first pressurized in a closed chamber and then releasing the pressure suddenly to separate the fibers. U.S. Pat. No. 2,823,868 Scherer discloses a comminuting apparatus wherein the material after mechanical comminution is delivered to a vacuum tank or receiver. This patent refers to the further breaking up of the particles under the reduced pressure in the receiver.

In some processing of minerals and the like wherein pulverization is a step in the process it is required that very fine and uniform particles of the material be obtained. While the processes known heretofore have been suitable for many applications they are not effective for all applications and, accordingly, it is an object of this invention to provide an improved pulverization method and apparatus employing vacuum comminution.

It is another object of this invention to provide an improved vacuum comminution method and apparatus which is simple and effective in operation and in construction.

It is a further object of this invention to provide an improved method and apparatus for vacuum comminution of minerals and the like which is capable of continuous operation and provides an increased degree of pulverization of the mineral at an increased rate of production.

It is a further object of this invention to provide an improved multi-stage method and apparatus therefor, which may be utilized with a single dust collecting apparatus.

The features of novelty which characterize this invention are set forth with particularity in the claims annexed to and forming a part of the specification. The invention itself, however, together with further objects and advantages thereof, will best be understood from the following description taken in connection with the accompanying drawings.

SUMMARY OF THE INVENTION

In carrying out the objects of this invention, in one embodiment thereof, a vacuum comminution system is provided which includes first and second fan type blowers connected in series in the air path, the discharge from the first blower being directed into the inlet of the second blower. At the inlet of each of the blowers there is provided a frusto-conical chamber forming a part of the air inlet conduit. These chambers increase in cross-section toward the respective blower inlets, and constitute low pressure zones in the system. The first blower is arranged with the inlet conduit and frusto-conical chamber in an upright position. The material to be pulverized is supplied through the conduit and it attains a relatively high velocity due to gravitational acceleration during its fall. The material enters the low pressure chamber suddenly and is shattered by vacuum comminution. The material thus pulverized is discharged with the air stream from the first blower and enters the low pressure chamber of the second blower suddenly and undergoes a high rate of change of pressure, and the material is further pulverized before passing through the second blower to the discharge duct of the system. The entire system is closed and sealed between the inlet conduit to the first blower and the discharge conduit from the second blower. Only one dust collecting system is required for the entire material pulverizing system.

BRIEF DESCRIPTION OF THE DRAWINGS

FIG. 1 is a diagrammatic illustration of a vacuum comminutor of the prior art, FIG. 2 is an end view of the comminutor of FIG. 1, and FIG. 3 is a diagrammatic side elevation view of a vacuum pulverizer embodying the present invention.

DESCRIPTION OF THE PREFERRED EMBODIMENT

FIGS. 1 and 2 illustrate a type of vacuum comminutor known heretofore. A fan type or centrifugal blower 10 driven by a motor 11 is arranged to draw air through a tube or conduit 12 and through a frusto-conical section 13 of the conduit through the central blower inlet 14 into the spiral casing 15 of the blower. During operation of the blower the interior of the frusto-conical section 13 is a low pressure zone. The material to be comminuted is in pieces or particles which are deposited in the tube 12 and this material is carried into the blower by the force of the air driven by the blower. When the material reaches the low pressure zone the sudden difference in pressure between the inside and the outside of the particles of material causes the particles to break or explode and this results in comminution of the particles of material. The degree of comminution may be varied by changing the speed of the motor. Further comminution may be effected by putting the comminuted material through the comminutor one or more additional times.

The present invention employs one or more comminutor units similar to that of FIGS. 1 and 2 in a system which makes it possible to obtain substantially more efficient pulverization of material and greatly improved pulverization. The present invention is based on the discovery that the pulverizing action produced in the vacuum comminuting process is not the result of the pressure difference alone but rather is the result of the rate of change of pressure. It was also observed that during the operation of the prior art systems wherein the material to be pulverized is drawn into the low pressure chamber by the suction or pressure difference generated by operation of the blower a substantial portion of the energy is used to move the material.

In the method and apparatus of the present invention an initial velocity which is independent of the blower is imparted to the material.

The material comminuting system shown in FIG. 3 employs two comminutor units 16 and 17 each similar to that of FIGS. 1 and 2 and having blower casings 15' and 15'', respectively, which correspond to the casing 15 of those figures. These two units are connected in series in the air flow path so that the energy of the air and material discharged from the first unit is used to drive the material at relatively high velocity into the second unit. In addition a gravity acceleration unit 18 is employed to drive the material into the inlet of the first unit at a substantial initial velocity. The unit 18 includes a long upright tube 19 supported on the frustoconical section indicated at 20 and extending upwardly and terminating in a funnel inlet member 21 into which the material to be pulverized is poured. The falling material is accelerated by gravity and enters the section 20 at the substantial initial velocity. Furthermore, the blower unit is not required to provide the power for the acceleration of the material to be treated.

The combination of the units 16 and 17 provides a completely closed system between the material inlet funnel 21 and the discharge from the unit 17 which is indicated at 22. The outlet of the unit 16 is connected to the inlet of the unit 17 by a cylindrical tube 23 which discharges the material comminuted in the unit 16 to the frustoconical section 23' of the unit 17. This utilizes the energy of the material discharged from the unit 16 to deliver the material at a relatively high initial velocity to the inlet of the unit 17. A single dust removal system at the outlet of the unit 17 is all that is required to meet the environmental regulations.

The units 16 and 17 are driven by electric motors 24 and 25 which are mounted and supported in a manner suitable for effecting the operation of the two blower units. Because the rate of disintegration or pulverization of the material is dependent upon the rate of change of pressure about the material, the units 16 and 17 are particularly effective in increasing the rate of comminution and the quantity of material which may be comminuted in a given period of time.

Tests were conducted to compare the operation of the prior art units of FIGS. 1 and 2 and that of the units embodying the present invention wherein the material is introduced at a substantial initial velocity. It was found that two units connected in series as illustrated in FIG. 3 provided very significant improvement measured in the degree of pulverization. Tests also showed that one pass of material through the series arrangement of the blower units produced significantly more pulverization than two separate passes through one of the units.

The comparative tests were conducted by employing standard samples of a prepared feed material. By way of example, a standard sample was passed twice through a vacuum type comminutor device like that of FIGS. 1 and 2, and then a standard sample was passed through two equivalent comminution devices connected in series, but without providing externally accelerated material at the inlet of the first device. Significantly more pulverization of the material occurred in the series arrangement as compared with the two passes through one device.

Depending on the requirements of a pulverizing operation, more than two vacuum comminutors may be connected in series. Regardless of the number of comminutor devices which are connected in series only one duct collecting system is necessary. By providing the gravity acceleration device for delivering the material to the inlet of the first device still further increase in performance was realized.

The tests demonstrated that the introduction of material to the low pressure chamber of a vacuum comminutor at an initial velocity shortens the time during which the pressure change occurs and results in more effective pulverization of the material.

When a number of vacuum comminutors are arranged in series a substantial improvement in the degree of pulverization is realized at each stage; there is also a saving in equipment, space, labor and expense as compared with the operating using multiple passes through separate comminutors.

While the invention has been illustrated and described in connection with a particular arrangement and construction various other arrangements and modifications will occur to those skilled in the art. Therefore, it is not desired that the invention be limited to the specific embodiment illustrated and described and it is intended by the appended claims to cover all modifications and embodiments which fall within the spirit and scope of the invention.

I claim:

1. In a vacuum system for effecting the comminution of minerals and other frangible substances, the method for increasing the rate of pulverization and the fineness of the product which comprises:

producing a low-pressure zone and a continuous flow of air into the zone and a discharge of air from the zone;

providing a mass of material to be pulverized; and injecting the material into the low-pressure zone at a significant initial velocity produced by a force independent of the force utilized for producing said low-pressure zone, whereby the material is subjected to a sudden corresponding increased rate of change of pressure upon entering said low-pressure zone.

2. The method of claim 1 wherein the injection of the material is effected by dropping the material from a substantial height into said low-pressure zone to utilize gravitational acceleration for producing the velocity of the injected material.

3. The method of claim 1 including the further step of providing an air blower and utilizing the blower for producing the independent force and wherein the step of injecting the material into the low pressure zone is effected by supplying the material to the input of the blower and directing the output of the blower into said low pressure zone.

4. The method of claim 1 including the further step of providing a plurality of fan type blowers connected in series each blower producing a respective low pressure zone including said first mentioned low pressure zone produced by the first blower in said series and injecting the material to be pulverized into said first zone by dropping the material from a substantial height toward and into said first zone, injecting the material into the next blower by directing the air discharge from the first blower into the low pressure zone of the next blower in said series whereby the material is driven at a corresponding increase initial, velocity into the low pressure zone of each blower and the comminution of the material is effected in a plurality of stages, each stage subjecting the material to a sudden increased rate of decrease of pressure.

5. In a vacuum type comminution apparatus for the pulverization of minerals and other frangible substances which comprises a blower for producing a flow of air from its inlet to its outlet and having a low pressure chamber adjacent its inlet, the improvement which comprises means independent of said blower for supplying the substance to said low pressure chamber at a significant initial velocity whereby the material entering said chamber is subjected to a corresponding increased rate of change of pressure.

6. The invention of claim 5, wherein said means for supplying the substance to be pulverized comprises an upright tubular column extending upwardly from the inlet of the blower and adapted to receive the material at its upper end whereby the material supplied to said column is accelerated by gravity to its initial velocity before entering said low pressure chamber.

7. The invention of claim 5, wherein said means independent of said blower for supplying the substance comprises a second similar blower having its outlet connected to deliver air and entrained comminuted substance to said low pressure chamber of the first mentioned blower and having its low pressure chamber adapted to receive the initial means of material to be comminuted.

8. The invention of claim 7, including means for imparting an initial significant velocity to the material supplied to the low pressure chamber of said second blower.

9. The invention of claim 5 or claim 6 wherein said low pressure chamber is of increasing cross section from its inlet to its outlet.

10. The invention of claim 7 or claim 8 wherein the low pressure chamber of each of said blowers is of increasing cross section from its inlet to its outlet.

* * * * *